United States Patent [19]

Benack et al.

[11] Patent Number: 5,019,472

[45] Date of Patent: May 28, 1991

[54] METHOD FOR DUPLICATING PRESS CHARACTERISTIC DOT GAIN IN ELECTROSTATIC PROOFING SYSTEMS

[75] Inventors: Kerin S. Benack, Chicago, Ill.; Arthur J. Taggi, Hockessin, Del.

[73] Assignee: E. I. Du Pont de Nemours and Company, Wilmington, Del.

[21] Appl. No.: 243,293

[22] Filed: Sep. 12, 1988

[51] Int. Cl.[5] ..... G03G 13/01

[52] U.S. Cl. ..... 430/43; 430/45; 430/103; 430/358; 356/404

[58] Field of Search ..... 430/42, 43, 45, 103, 430/358; 356/404

[56] References Cited

U.S. PATENT DOCUMENTS

| | | | |
|---|---|---|---|
| 3,886,900 | 6/1975 | Deshayes et al. . | |
| 3,889,637 | 6/1975 | North et al. . | |
| 3,921,579 | 1/1975 | Wright . | |
| 3,957,016 | 5/1976 | Yamada et al. . | |
| 4,155,330 | 5/1979 | Weitzel . | |
| 4,278,884 | 7/1981 | Landa | 250/315.2 |
| 4,358,195 | 11/1982 | Kuchule et al. | 430/42 X |
| 4,420,244 | 12/1983 | Landa | 355/3 TR |
| 4,522,484 | 6/1985 | Landa | 355/3 DD |
| 4,600,669 | 7/1986 | Ng et al. | 430/353 X |
| 4,708,459 | 11/1987 | Cowan et al. | 355/4 |
| 4,820,618 | 4/1989 | Lawson et al. | 430/45 |

FOREIGN PATENT DOCUMENTS 58-91767 12/1984 Japan .

OTHER PUBLICATIONS

"Cromalin ®-Offset COM Guides/System Brunner", by E. I. Du Pont de Nemours and Company, 1984.

*Primary Examiner*—Roland E. Martin

[57] ABSTRACT

A method for electrostatically producing prepress printing proofs that accurately predict results of actual press runs for a given press having known or desired characteristic response.

11 Claims, 3 Drawing Sheets

METHOD FOR DUPLICATING PRESS CHARACTERISTIC DOT GAIN IN ELECTROSTATIC PROOFING SYSTEMS

BACKGROUND OF THE INVENTION

1. Field of the Invention

This invention relates to electrostatic proofing systems and, more particularly, to a method by which dot gain may be controlled to provide a preview of press results.

2. Description of the Prior Art

Reproduction of color images through printing is an involved process requiring a breakdown of an original image into a number of fundamental, single color images and the eventual recombination of the single color images through multiple printings into a full color reproduction of the original. In its most elementary form, color image reproduction requires the following sequential steps.

First, using filtering and other photographic techniques a number of color separation transparencies are produced (typically four) each bearing a halftone dot image corresponding to the magenta, cyan, yellow and black portion of the original, respectively. A transparency bearing a halftone dot image is one in which various optical densities of a given image are reproduced by a multiplicity of opaque or transparent dots per unit area, the dots having varying diameters.

Second, the color separation transparencies are next used to produce printing plates corresponding to each of the four colors.

Third, the printing plates are mounted on multistage printing presses which print sequentially, in register, one on top of another, four halftone images corresponding to each of the color separations to create a full color reproduction of the original.

The various colors and hues are reproduced by the superposition of a multiplicity of dots of varying diameters and colors corresponding to the four color separations. Any deviation in the size of the printed dots results in color shifts in the final printed image. As a result of this reproduction process, setting up the press and printing a four color image is economically feasible typically only when employed for printing large quantities of a given subject.

It is desirable to be able to predict the final image appearance before it is printed, and preferably before even making printing plates by studying images made directly from the color separation transparencies.

The art of evaluating the color separation transparencies and deciding whether the various colors have indeed been properly separated is called proofing. Proofing is a predictive process which uses the information in the color separations to create an image taking into account known effects or errors that normally occur during the printing process. Proofing is used to visualize what the final printed image will look like without actually making printing plates and running the printing press. This way, the color separations may be timely corrected.

Methods have been developed and are well known in the art to test the color separations without an actual printing run. See for instance "Principles of Color Proofing" by M. H. Bruno, published by Gama Communications, Copyright 1986.

One of the problems that affects the final print is variations in the diameter of the dots comprising the halftone image. For instance, assume that a given tint and color density in a portion of an image is to be reproduced accurately using a given set of inks and a combination of four color separation transparencies. These may be, for example, a yellow color separation with dots having a diameter of 0.010 inches, a cyan color separation with dots having a diameter of 0.020 inches, a magenta with dots of 0.030 inches and a black with dot diameters of 0.015 inches. Upon printing, however, the image shows an unacceptable tint. Upon measuring the actual printed dot diameters on the printed image, we find that even though the dots on the printing plates correspond exactly to the dot size on the color separations, the yellow dot diameter is smaller than 0.010 by 10% while the others are larger by 5% to 20%. This may have resulted because our printing press happens to be printing light on the yellow, but heavy on the other colors, resulting in dot shrinkage or growth. To compensate for that, we must make our printing plates with bigger diameter dots than the "correct" size for the yellow separation, and the others with smaller diameter dots than the "correct" size.

In order to have a quantitative, as well as a qualitative, understanding of this dot growth problem, and to be able to generate color separations that will eventually produce printing plates which compensate for the various changes to the dots in each particular press, there have been developed in the art measuring systems, such as the System Brunner Isocontour curves discussed in the aforementioned Bruno publication, in Pages 260 to 270. Using special printing test targets containing colored patches of preselected dot sizes, printed alongside an image, a press operator may measure colored areas having dots of a preselected diameter and determine any deviation therefrom. This in turn tells him how much dot growth or shrinkage is introduced by his press. By having this knowledge, and given a proofing system in which he can introduce at will dot growth or shrinkage similar to that of his press, he can produce proofs that show the exact output of his press, and can, therefore, correct his color separations accordingly.

While System Brunner Isocontour curves and the like, are very useful in predicting the results of press dot growth or shrinkage in traditional printing, they have not heretofore been used with electrostatic printers even though such printers are capable of producing four color prints in short runs and short times, such as described in U.S. patent application Ser. No. 07/117,269, filed Nov. 4, 1987, which issued into U.S. Pat. No. 4,849,784 and assigned to the assignee of the present invention.

What is needed is a method to produce color proofs in electrostatic printing equipment and to allow one to evaluate the color separations, without having to make printing plates and prints on a printing press.

Therefore, it is an object of this invention to provide a method which allows one to electrostatically produce color proofs that accurately predict the results of actual press runs for a given press of known characteristic response, i.e., whose dot gain versus the dot percentage coverage is known or can be measured.

SUMMARY OF THE INVENTION

The present invention fulfills the above described objectives and comprises a method for developing a halftone electrostatic image on a master in an electrostatic proofing system, the image consisting of a plurality of dots having varying diameters and conductivity different than a remainder of the master, comprising the steps of:

applying a layer of liquid toner on the master; and subjecting the image to a preselected electrical field to control toner receptivity of portions of the image to produce a predetermined change in the diameter of the dots to simulate a printed image having a predetermined dot gain in accordance with known or desired dot gain values.

BRIEF DESCRIPTION OF THE DRAWINGS

FIG. 3(*b*) shows the rise and fall of the charge distribution on the master representing a halftone dot.

FIG. 3(*c*) shows the rise and fall of the optical density of a toned halftone dot.

DETAILED DESCRIPTION OF THE PREFERRED EMBODIMENTS

Figure 1:
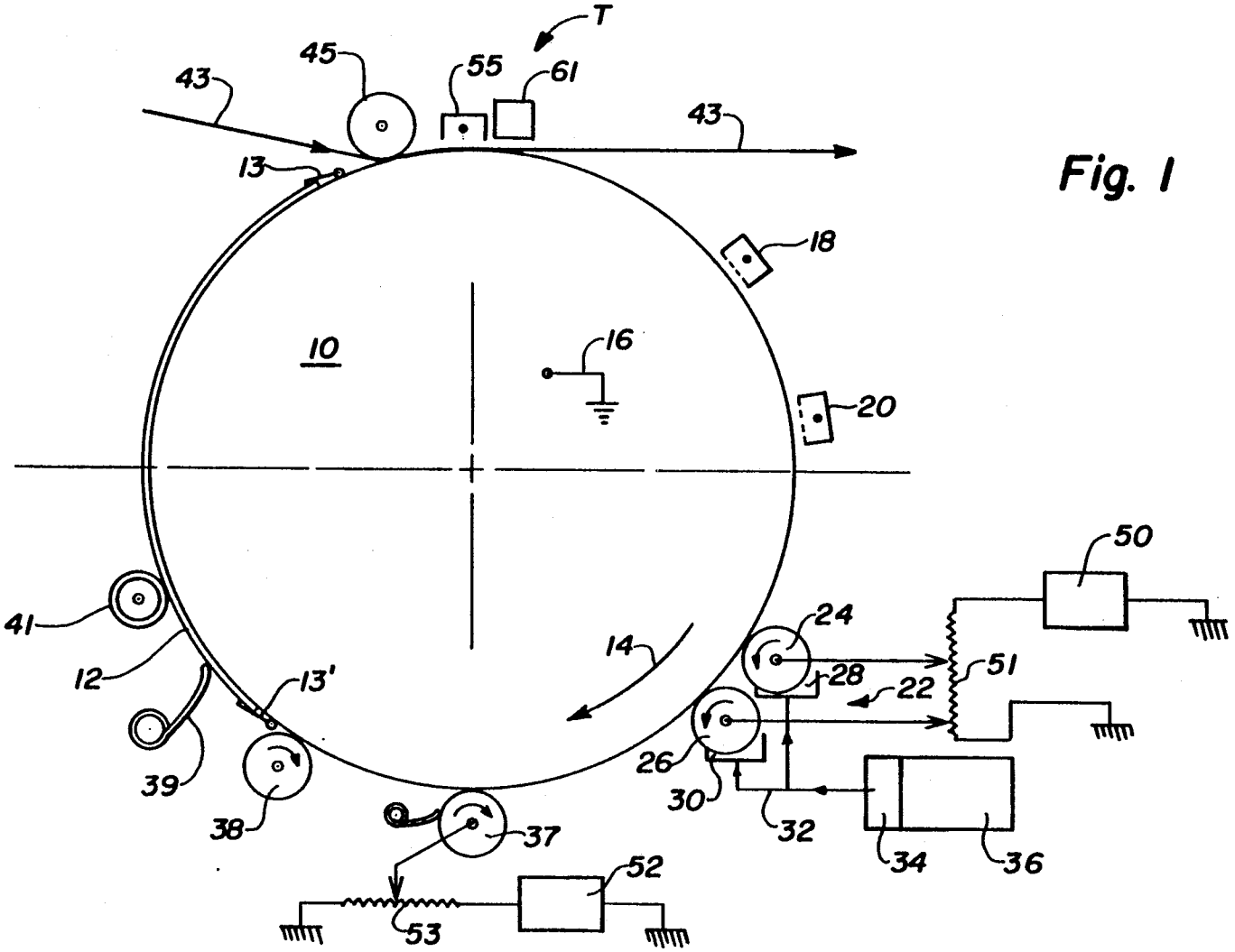
FIG. 1 is a schematic representation of an elevation view of a single color electrostatic printing station in accordance with the present invention.

In FIG. 1, there is depicted in schematic form one of four substantially identical printing stations of an apparatus useful for producing color proofs in accordance with the present invention from plates subjected to previous exposure having areas of varying conductivity in accordance with such pre-exposure.

Each printing station comprises a rotating drum 10 which is rotated in the direction of arrow 14 by means not shown in the Figure and well known in the art. On the surface of the drum 10, there is mounted a master plate or master 12 through the use of any of a number of well-known clamping mechanisms, generally depicted here by numerals 13 and 13'. The master plate 12 has been pre-exposed through a halftone color separation transparency having a halftone image corresponding to one of the four color separations needed to generate a color proof. Such halftone image typically comprises a multiplicity of dots of varying diameters, the dots being either opaque on a transparent background or transparent on an opaque background. As a result of this pre-exposure, certain areas in the master 12 have been rendered substantially more electrically conductive than others, in a manner as to reproduce in a latent form the transparency image.

Along the periphery of the drum 10 are positioned a number of machine elements, or modules, which upon command operate to act on the master 12 in any one of a predetermined number of ways. Starting at the upper right hand, side there is located a corona charging module 18. Such corona charging modules are well known in the art and the particular design is of no special interest, provided it is able to deposit a charge with a high degree of uniformity on the surface of the master 12. A scorotron having a screen on the side facing the master has been found satisfactory.

Proceeding clockwise, there is a second corona device, referred to as a discharge module 20. This may also be a scorotron of similar structure as the one used in module 18, but to which is applied an A.C. voltage to uniformly neutralize the remaining charges on the master 12 following image transfer and provide a background of very low charge level on the master 12.

A toning module 22 follows the discharge module 20. It comprises one and preferably two rotating rollers 24 and 26 which rotate partially immersed in liquid toner trays 28 and 30, respectively. The direction of rotation of rollers 24 and 26 is shown by the arrows, and is such that their outer surface is turning in the direction of the outer surface of drum 10 where they come into close proximity or contact. Means not depicted for the sake of clarity allow the rollers 24 and 26 to be moved in and out of proximity or contact with the drum 10. Spacer means not shown may be provided to maintain the roller surface at a preset distance from the drum surface. A toner reservoir 36, pump means 34 and a conduit arrangement 32 are also provided to assure an adequate supply of liquid toner to the rollers.

In the present arrangement, following the toning module, there is placed a metering roller 37 which rotates in a direction such that its surface moves in the opposite direction than that of drum 10 at the point where they face each other. The purpose of this roller is to wipe off excess toner from the surface of a toned master. Typically, the surface of this roller 37 is spaced about 0.004 inches from the surface of a master plate mounted on the drum 10, but that distance may vary. Means not shown are also provided to move this roller in and out of proximity with drum 10.

A cleaning module including a roller 38 is next provided which is used to wipe clean the surface of the master 12 following image transfer and prior to recharging for the next image. Roller 38 may be followed by a wiper blade 39 and a blotter roll 41. No details are shown, but such cleaning modules are well known in the art, and the particular design selected is of no consequence, provided it is adequate to remove any left over toner following image transfer.

A transfer station T is located next in a clockwise direction and comprises three sections. A tack down roller 45, which serves to bring a transfer paper moving along a path 43 into contact with the master 12, is followed by a transfer corona station 55 and paper separator means 61. Previously mentioned U.S. patent application No. 07/117,269 provides a full description of a preferred embodiment of the transfer station for use in the present invention, as well as a description of the operation of the single color electrostatic printing station of FIG. 1, and is incorporated by reference herein.

The drum 10 is typically maintained at ground potential, as shown by numeral 16. Appropriate power supplies 50 and 52 and electrical connection means 51 and 53 apply selectively variable electrical voltages to the rotating toner rollers 24 and 26 and the metering or reverse roller 37, respectively.

Figure 2:
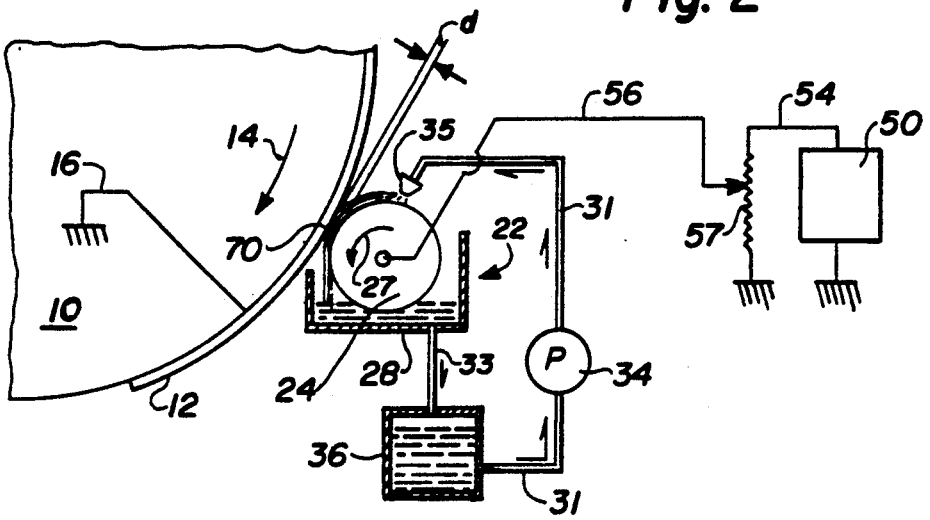
FIG. 2 is an enlarged simplified schematic representation of a toning station shown in FIG. 1.

A portion of toning station 22, is shown in FIG. 2 in which for simplicity one roller only is shown, the second, if employed, being of identical structure in a similar arrangement. Briefly, the station 22 comprises means to bring liquid toner 70 in contact with the master 12 which is mounted on the surface of drum 10, and moving in the direction of arrow 14. The roller 24 rotates in the direction of arrow 27. Liquid toner 70 is supplied to the surface of roller 24 through a nozzle 35 connected through a fluid conduit system 31 from a reservoir 36. A pump means 34 is used to circulate the toner. A toner collecting tray or trough 28 is placed under the roller 24 to collect used toner and return it through conduit 33 to the reservoir 36. Toner replenishment means, not shown, may be optionally provided.

As stated before, means not shown are available to move the toner roller in and out of proximity with the drum. When the toner station is active, the toner roller 24 is placed at a distance "d" from the surface of the master 12. Preferably such distance "d" between the surface of the master 12 and the roller 24 is about 0.006 inches even though other distances between about 0.001 inches and about 0.015 inches or larger may be used, without detriment to this invention. The distance must be such that the liquid toner 70 extends between the master surface and the roller surface.

A power supply 50 is operatively connected through wires 54 and 56 and via voltage selector 51 to apply a selectable voltage to roller 24. Roller 24 has preferably a conductive surface to which the voltage from voltage selector 57 is applied. As a result an electrical field "E" is established between the surface of the drum 10 and the toner roller 24 outer surface. When a charged master is placed between the drum surface and the toner roller, an electrical field which will be a composite of the field due to the charges on the master and field "E" develops between the surface of the master 12 and the surface of the toner roller 24.

Figure 3:
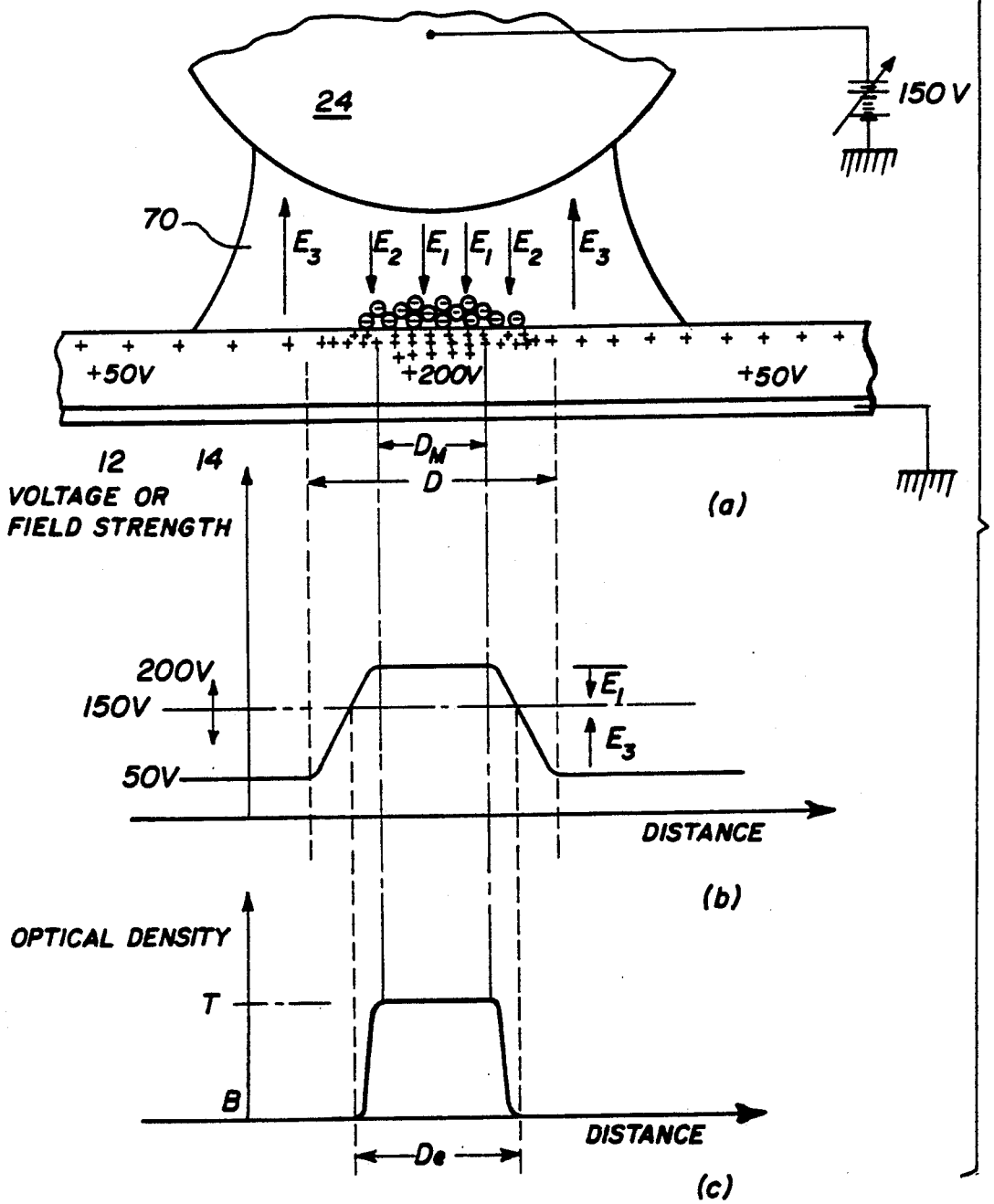
FIG. 3(*a*) shows in schematic representation a charged master traversing the toning station in accordance with the present invention and the Electric fields present therein.

Referring now to FIG. 3 and more particularly to FIG. 3(*a*), there is schematically represented a section of the master 12 passing roller 24 and through a pool of liquid toner 70. For purposes of explaining this invention, assume a bias electric voltage of 150 volts direct current (VDC) is applied to the roller 24 generating a field "E" equal to 150 volts (V) between the roller 24 and the surface of the master 12, in the absence of a charge thereon. This of course is a simplification, since such field calculation does not include the thickness of the master and its dielectric properties. However, for purposes of understanding the present invention such simplification presents no impediment and makes the explanation simpler.

Let us further assume that the background residual charge on the master surface generates a potential difference of 50 volts (V) positive with respect to ground. Furthermore, we will assume that a dot on the master is represented by an area of increased charge, the charge rising rapidly from the background level to a maximum, leveling off and dropping again rapidly to the background level as shown in FIG. 3(*b*). The distance between the point where the charge first begins to increase and where it finally drops back to background level is labeled "D". "D" is the maximum measure of a given dot diameter. The distance between the beginning and end of the maximum charge concentration is labeled "Dm". It is of course desirable to have "Dm" equal to "D", however, typically "Dm" < "D". Finally, let us assume that the maximum charge density generates a potential difference of 200 volts (V) positive with respect to ground level.

Based on the above, and again simplifying the calculations as before, the resulting field distribution between the surface of the master 12 and the roller 24 within the liquid toner pool may be represented by "$E_x$". Referring again to FIG. 3(*b*), "$E_3$" will equal 100 volts positive, since it is the result of "E" (which equals 150 V) less the "background field" generated by the master (which equals 50 V). "$E_1$" which corresponds to the maximum charge will be 50 volts negative, since "E" (which equals 150 V) less the "maximum density field" (which equals 200 V) yields −50 volts. "$E_2$" will take a variety of values between +100 volts and −50 volts.

The amount of toner particles deposited on the charged areas depends of course on the applied field. Negatively charged toner particles will be attracted or repelled to the surface of the master as a result of the residual or the locally effective field. Thus, in the area of "$E_3$", the field direction is such that negatively charged toner particles will migrate to the surface of roller 24 which appears 100 volts positive relative to the master surface. Similarly, toner particles will migrate to the surface of the master 12 from that point on where the field has become negative, i.e., the potential difference between the roller 24 and the master 12 is such that the master surface is higher than the roller 24, or, in other words, where the roller 24 is at a negative potential relative to the master. This occurs for points inside of "D" having a charge density yielding a potential of more than 150 V, i.e., the potential of the bias voltage applied to the roller 24. These points are designated as the segment "$D_e$" in FIGS. 3(*b*) and 3(*c*). Depending on the value of the bias voltage, "$D_e$" may be varied at will between "D" and "$D_m$" allowing us to control the size of the toned dot.

This control of the electrostatically printed dot may be advantageously used to produce proofs that accurately depict the results that will be obtained using a given set of color separation transparencies, printing press, inks and paper as follows.

First, using a preselected test target, typical of the test targets used in the proofing arts, such as the Du Pont Cromalin ® Offset Com Guides/System Brunner or the GCA/GATF Proof Comparator, or any similar target, and an electrostatic printing station or device having the capability of controlling the electric field applied either to the toning station or to the reverse roller wiping station or to both, in a manner to control the effective dot diameter as discussed above, a series of prints is made for a number of preselected bias voltages. The Du Pont Cromalin ® Offset Com Guide includes halftone patches of 25%, 50% and 75% dot areas (i.e., patches in which the sum of the dot area covers 25%, 50% and 75% of the total patch area). The other test targets are similar in nature.

Figure 5:
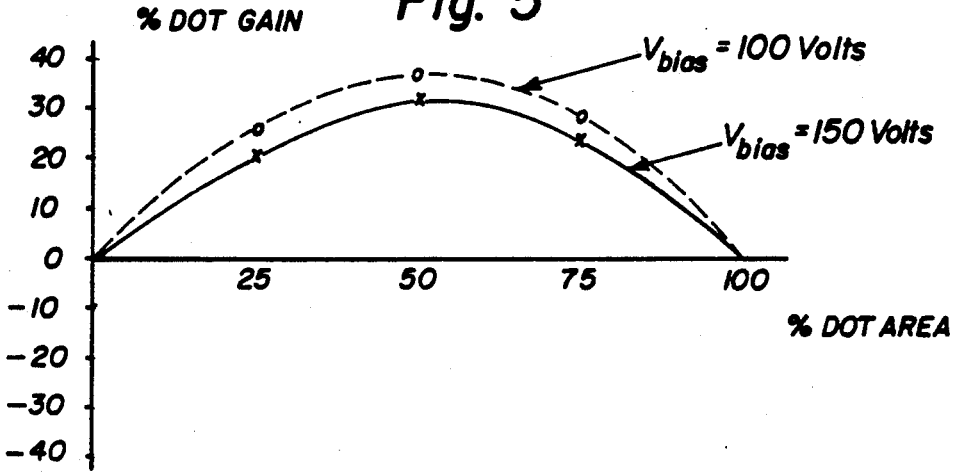
FIG. 5 shows a family of curves representing percent (%) dot gain as a function of percent (%) dot area, for constant bias voltages.

The percent (%) dot gain or loss is measured and recorded for each of the printed dots in each of the printed patches, and the bias voltage is recorded to generate a table of control or reference values for different bias voltages. In the alternative, the percent dot gain or loss for a given dot area patch at a fixed bias voltage may be plotted to provide a family of curves giving a graphic representation of the relationship of dot gain as a function of bias voltage. FIG. 5 shows such a family of curves including two such curves with bias voltages of 100 volts and 150 volts, respectively. For the 150 volt bias, for instance, the curve shows that the 25% dot area dots have increased in diameter by 20%, the 50% dot area dots by 30% and the 75% dot area dots by 22%. For the 100 volt bias, the curve shows the dot gain or dot diameters increased in comparison to the 150 volt bias.

The percent dot gain of a press may also be obtained using such a test target. In most cases, however, the press characteristics are already known for a given press, ink, paper, plate, etc., and a set of values or a curve giving the percent dot gain (or loss) for specific printing conditions is already available.

In order to produce on the electrostatic printer a proof that predicts the press results, one selects a bias voltage for each color separation printing station, such that the corresponding set of dot gain values or dot gain curve, closely match the known or measured press dot gain values or curve, respectively. Upon printing, the electrostatically produced proof will have dots that exhibit a dot gain or loss equivalent to the dot gain or loss that will be produced by the press during actual printing, thus allowing an accurate prediction of the press results for a given set of color separation transparencies.

The invention has been described in reference to FIG. 2 using a single stage biased toner roller. However, similar results may be obtained when two rollers are employed and either or both are biased. In addition where a reverse, metering roll 37 is employed, the bias voltage may be applied to it either alone or in conjunction with the toner rollers 24, 26 to obtain the same result. What is important is that the controlling field due to the biasing voltage be present under conditions which allow toner particles to migrate in a fluid so that particles may be added or removed from the charged portions of the master 12.

Of course, while the invention has been described with reference to a cylindrical, rotating system employing roller electrodes, the electrodes can be concentric stationary cylindrical elements or flat elements, or the whole system may be flat rather than curved. Furthermore, although the invention has been described with reference to a toning module comprising one and preferably two rotating rollers which rotate partially immersed in liquid toner trays, the toning module may comprise a toning shoe.

Figure 4:
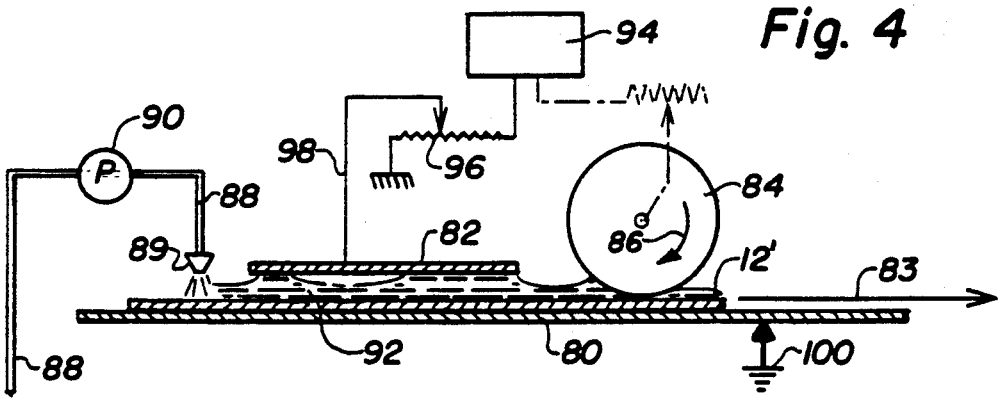
FIG. 4 shows an alternate, flat, embodiment of a toning station in accordance with present invention.

A schematic toning station for a flat horizontal system may, for instance, comprise an electrically grounded transport belt 80 as shown in FIG. 4 moving a master 12' along a path indicated by arrow 83. Placed above the belt 80 and spaced therefrom is a flat electrode plate 82. Plate 82 is at a distance such that the distance between the upper surface of the master 12' and the bottom surface of the plate is between 0.001 inches and about 0.015 inches. A liquid toner dispensing means, such as a nozzle, 89 is provided ahead of the electrode plate 82 to supply a quantity of liquid toner to form a pool 92 on the master, extending and completely filling the space between the master 12' and the electrode plate 82. Conduit means 88 and a pump means 90 supply toner from a reservoir not shown in the Figure. A power supply 94 is connected through a bias voltage selector means 96 and connecting means 98 to the electrode plate 82 to apply a selectable D.C. bias voltage thereto. Grounding means 100 are provided to ground the belt 80.

A reverse roller 84 rotating in the direction of arrow 86 is provided past the electrode plate 82 in the direction of the belt movement to wipe off excess toner from the surface of master 12'. The reverse roller 84 may, optionally, be biased as shown by the phantom lines in FIG. 4.

The above and other embodiments readily perceived by the practitioners in this art having the advantage of the teachings herein are to be construed as being within the scope of the present invention as set forth in the appended claims.

We claim:

1. A method for use in a halftone electrostatic proofing system comprising a plurality of printing stations, each one of the stations having a master with a latent halftone electrostatic image, a corona charging module adapted to deposit a charge on the master, a toning module for applying an electrostatic toner to the master and a transfer station for transferring toner from the master to a transfer paper, the image consisting of a plurality of dots having varying diameters and conductivity different than a remainder of the master, comprising the steps of:

applying a layer of liquid toner on one of the masters; and subjecting the image with the layer of the toner to a preselected electrical field to control toner receptivity of portions of the image to produce a predetermined change in the diameter of the dots to simulate a printed image having a predetermined dot gain in accordance with desired dot gain values, wherein the subjecting step further comprises producing the change in the diameter of the dots to simulate the printed image having a predetermined dot gain curve.

2. The method as set forth in claim 1, wherein the subjecting step occurs during the applying step.

3. The method as set forth in claim 1, further comprising the step of:

metering the liquid toner to control thickness of the layer; and wherein the subjecting step occurs during the metering step.

4. The method as set forth in claim 1, wherein the subjecting step occurs after the applying step.

5. The method as set forth in claim 4, further comprising the step of:

metering the liquid toner to control thickness of the layer; and wherein the subjecting step occurs between the applying step and the metering step.

6. The method as set forth in claim 1, wherein the electrostatic proofing system further comprises:

metering means for controlling thickness of the layer; and wherein the preselected voltage is applied to the metering means generating the preselected electrical field.

7. The method as set forth in claim 6, wherein the preselected voltage is also applied to the at least one development electrode generating an additional electrical field.

8. A method for use in a halftone electrostatic proofing system comprising a plurality of printing stations, each one of the stations having a master with a latent halftone electrostatic image, a corona charging module adapted to deposit a charge on the master, a toning module for applying an electrostatic toner to the master and a transfer station for transferring toner from the master to a transfer paper, comprising the steps of:

applying electrostatic toner to the latent electrostatic image on one of the masters in the presence of a development electrode; and selecting a voltage for the development electrode to control dot gain to simulate a printed image having a predetermined dot gain, wherein the selecting step further comprises simulating the printed image having a predetermined dot gain curve.

9. The method of claim 8, further comprising the step of:

subjecting the electrostatic image to an electrical field resulting from the voltage.

10. The method of claim 9, wherein:

the subjecting step occurs during the applying step.

11. A method for use in a halftone electrostatic proofing system comprising a plurality of printing stations, each one of the stations having a master with a latent halftone electrostatic image, a corona charging module adapted to deposit a charge on the master, a toning module for applying an electrostatic toner to the master and a transfer station for transferring toner from the master to a transfer paper, comprising the steps of:

applying liquid electrostatic toner to the latent electrostatic image on one of the masters; and removing excess toner by applying a preselected voltage to toner metering means for controlling dot gain to simulate a printed image having predetermined dot gain, wherein the removing step further comprises simulating the printed image in accordance with a predetermined dot gain curve.

* * * * *